United States Patent [19]

Long

[11] Patent Number: 4,571,860

[45] Date of Patent: Feb. 25, 1986

[54] METHOD AND APPARATUS FOR REMOVING ICE FROM PAVED SURFACES

[76] Inventor: Howard W. Long, 3436 Upland Dr., Anchorage, Ak. 99504

[21] Appl. No.: 514,778

[22] PCT Filed: Nov. 17, 1982

[86] PCT No.: PCT/US82/01622

§ 371 Date: Jul. 18, 1983

§ 102(e) Date: Jul. 18, 1983

[87] PCT Pub. No.: WO83/01798

PCT Pub. Date: May 26, 1983

[51] Int. Cl.[4] ..... E01H 5/00

[52] U.S. Cl. ..... 37/197; 37/268; 404/31; 404/75; 404/79; 34/1; 219/201

[58] Field of Search ..... 37/197, 266, 268–270; 404/79, 95, 19, 21, 17, 72, 31, 32; 427/386; 106/DIG. 1, 288 Q, 281 R, 273 R; 34/1; 219/201, 553

[56] References Cited

U.S. PATENT DOCUMENTS

| | | | |
|---|---|---|---|
| 2,706,936 | 4/1955 | Willson, Jr. | 404/21 |
| 2,948,201 | 8/1960 | Wagin et al. | 404/21 |
| 3,050,493 | 8/1962 | Wagner et al. | 404/17 X |
| 3,626,149 | 12/1971 | Carney | 219/213 |
| 3,732,791 | 5/1973 | Hohwiller et al. | 404/32 |
| 3,839,518 | 10/1974 | Rubens et al. | 404/32 |
| 3,964,183 | 6/1976 | ·Mouat | 406/79 X |
| 3,986,781 | 10/1976 | Condo et al. | 404/31 |
| 4,162,998 | 7/1979 | Dol et al. | 404/79 |
| 4,196,103 | 4/1980 | Dannenberg et al. | 404/17 X |
| 4,249,323 | 2/1981 | Mathis et al. | 37/266 X |
| 4,319,856 | 3/1982 | Jeppson | 404/79 |
| 4,370,534 | 1/1983 | Brandon | 34/1 |

FOREIGN PATENT DOCUMENTS

| | | | |
|---|---|---|---|
| 677545 | 8/1966 | Belgium | 404/21 |
| 2426521 | 5/1974 | Fed. Rep. of Germany | 404/17 |
| 2453151 | 5/1976 | Fed. Rep. of Germany | 37/227 |
| 6603102 | 9/1966 | Netherlands | 404/17 |
| 6614046 | 4/1967 | Netherlands | 404/17 |
| 630334 | 10/1978 | U.S.S.R. | 404/17 |

*Primary Examiner*—E. H. Eickholt

*Attorney, Agent, or Firm*—Shlesinger Arkwright Garvey & Fado

[57] ABSTRACT

To remove ice and snow from pavement (1) having a carbonaceous top surface (4), a 915 M-Hz micro-wave generator with wave guide (8) is passed over the ice (13) followed closely by a scraper (10). Concrete pavements (1) are first coated with a reflective (2), heat-insulating (3) and carbonaceous (4) top coat or other carbonaceous coating while asphalt pavements need not be so coated. The micro-waves at this frequency pass through the ice (13), the carbonaceous top surface (4) absorbs the micro-waves and becomes heated thereby, the interface (12) between the ice (13), so freed, is scraped off without damaging the pavement (1).

22 Claims, 2 Drawing Figures

METHOD AND APPARATUS FOR REMOVING ICE FROM PAVED SURFACES

TECHNICAL FIELD

This invention resides in the fields of micro-wave heating and the removal of ice from surfaces.

BACKGROUND ART

Considerable time and expense are utilized to free paved roads, airport runways and walks from ice in cold climates. Expendable materials which are destructive to pavements and machinery alike are used in large quantities, and when removed with the partially melted ice and snow, often require special dumping areas for various reasons. An example of one such material is the salt spread on many road surfaces which, when thrown up against wheel wells, metal flooring, frames and running gear of road vehicles, results in accelerated rust and thus greatly reduces the life of vehicles. Another example is the use of considerable quantities of urea on airport runways, requiring high acquisition, storage and disposal costs, and in addition resulting in very disagreeable odors when the ice melts.

Various schemes have been proposed to better solve this problem of ice removal which must be accomplished to allow the safe use of streets, highways, intersections, walks and airport runways. Proposals include that of Mouatt, U.S. Pat. No. 3,964,183, in which he concentrates an intense beam of visible light onto the interface of a coating of ice, snow or frost and the top surface of a pavement adequate to raise the temperature of the interfacial zone to the melting point of water so as to free the icy coating from the pavement and then quickly remove the ice, so freed, by other apparatus before it re-freezes. As inventor Mouatt notes, infra-red radiation has also been used in an attempt to remove ice from pavements. Mechanical means used alone, as he infers, fail to completely clean the surface of ice because of the adhesive forces between ice and other common materials, which forces exceed the internal cohesive strength of ice itself. The infra-red radiation method failed because of the need to supply the heat of fusion to the entire thickness of ice, coupled with the insulating effect of the standing water so formed above the remaining thickness of ice.

In a different field, micro-wave energy is proposed for use in U.S. Pat. No. 3,443,051 to Puschner to develop thermal wedge forms in rock to split the rock. Inventor Stone in U.S. Pat. No. 3,601,448 uses two micro-wave generators, spaced apart from one another and directed at concrete or rock, to produce spaced heat zones to expand the material so as to place high tensile forces on the unheated material between the heat patterns. In U.S. Pat. No. 4,175,885, inventor Jeppson discloses a method of producing a composite pavement in which a 915 M-Hz micro-wave generator and wave guide are passed very slowly over a cement concrete pavement, with the additional use of hot gas to heat the concrete to the depth of about 6 inches, so as to drive off moisture and use the hot concrete to lower the viscosity of a thermoplastic sealer for maximum penetration of sealer into the interstices of the concrete. However, the surface of concrete can be damaged by spalling when heat is applied.

DISCLOSURE OF THE INVENTION

This invention is a way of removing ice and snow from a pavement having a carbonaceous top surface by passing over such carbonaceous top surface a 915 M-Hz micro-wave generator and wave guide in order to raise the temperature of the carbonaceous surface sufficiently to weaken or melt the ice at the interface of the ice and carbonaceous surface so that the ice may be scraped from the carbonaceous surface and removed therefrom. Concrete pavements are prepared for this process of ice removal, when dry, by covering it first with a tightly adhering layer of an adhesive sealer containing a continuous heat conducting and reflecting material, an intermediate layer of heat insulating material and a top layer of a wear resistant material containing a micro-wave absorptive carbonaceous material. Asphalt materials, being carbonaceous, do not require the application of these coatings. When a concrete pavement so prepared or when an asphalt pavement has been coated with ice, a 915 M-Hz micro-wave generator and wave guide unit is passed over the ice, the micro-waves at this frequency pass through the ice, the carbonaceous material of the pavement becomes heated thereby, the interface between the ice and ice-coated pavement is melted by conduction with the micro-wave heated surface of the pavement, and the ice, so freed from the pavement, is scraped from the pavement without damaging the pavement. Thus, this invention provides an efficient way to remove ice and snow from pavement without the use of disposable chemicals to melt the ice and without the excessive use of energy.

BEST MODE FOR CARRYING OUT THE INVENTION

Figure 1:
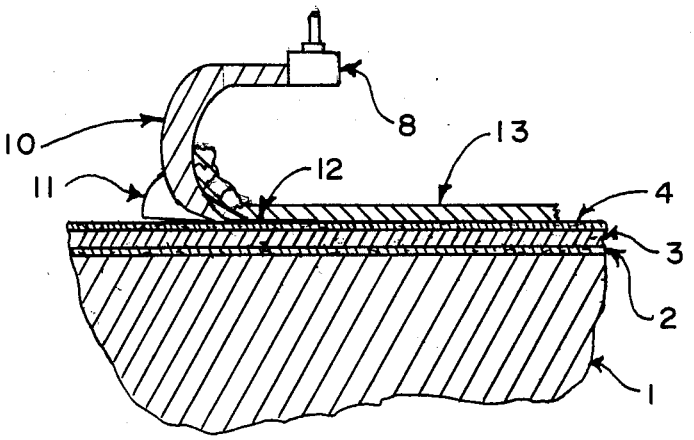
FIG. 1 is a cross-section of a concrete pavement coated so as to facilitate or allow the removal of ice from it by micro-wave energy according to my invention.

In the sectional view of FIG. 1, a concrete pavement 1 has been prepared for the winter by a three layer top coat applied thereto. Before application of the top coat, the pavement is cleaned so as to provide a clean, dry, dust-free surface for strongly adhering each layer to the pavement and to each other.

The first layer 2 of the coating to be applied to the concrete pavement is an epoxy containing aluminum flakes and/or powdered aluminum. The aluminum is used to reflect the heat from the micro-waves absorbed in the top layer 4 and to insure a relatively even temperature of the concrete pavement 1 during heating of the coating for ice removal.

The second or intermediate layer 3 is a rigid foamed phenolic sheet tightly adhered to the bottom layer 2 by a coating of epoxy. The purpose of the second layer 3 is to provide another heat-insulating layer between the concrete pavement 1 and the top layer 4 of the coating, thereby greatly limiting conductance of heat from the top layer 4 to the bottom layer 2 so as to retain the heat in the top layer 4 for conductance into the interface 12 of the ice and the top layer 4.

The third or top layer 4 of the coating applied to the concrete pavement 1 is a mixture of epoxy and graphite in a proportion of about 95% epoxy to 5% graphite. This thin layer is highly conductive and being graphite-filled will totally absorb or attenuate the microwaves and put the heat on the top surface in order to instantly release the hard ice by melting the interface 12 without warming the remaining thickness of the coating. Heat so generated in the top layer 4 is readily transferred to the interface 12 of ice 13 in contact therewith because of the high conductivity of both graphite and epoxy. Because ice is a poor conductor of heat, a relatively thin layer of graphited epoxy is required to quickly melt the interface 12 so as to free the ice from the coated pavement 1. A small proportion of relatively fine silica or similar material may be included in this top layer 4 of the coating to improve strength, rigidity, wear resistance and skid resistance. These qualities are desirable to protect the coating, giving it a longer life.

Since asphalt pavements are not brittle, as is the case with concrete, but are elastic, such a surface does not require the protection from heat with the epoxy and aluminum flake coating 2 and/or the intermediate phenolic sheet layer 3 applied to the concrete pavement 1. Likewise, since asphalt pavements are carbonaceous, the top layer 4 of epoxy and graphite as applied to concrete pavements 1 is not required. Thus the asphalt pavement does not require special treatment to practice my invention.

An essential of my invention is to use the ability of microwaves of relatively high frequency, at about 900 megacycles to readily pass through ice without melting the ice and to be absorbed by carbonaceous materials, such as graphite or asphalt. This is in contrast with the effect of the much lower frequency 24–27 megacycle micro-waves, as used in a domestic micro-wave oven, which will readily melt an ice cube wrapped in clear plastic wrap placed therein. Since the 900 range megacycle micro-waves will pass through ice to be absorbed by the carbonaceous materials, no energy is required to raise the temperature of the layer of ice through the heat of fusion to transform it to water. Since much less energy is required to melt the interface 12 between the carbonaceous surface and the layer of ice 13 than to melt the entire layer of ice 12, not only is power saved, but, as the micro-wave generator wave guide 8 is passed over the ice-coated pavement 1 at a much higher velocity than would be required to melt the ice 13, the ice 13 so freed is lifted and removed by the scraper blade 10. Since very little ice is converted to water at the interface 12 compared to if the ice were melted, the pavement so freed of ice will provide a much safer surface. It will be appreciated that if the ice is melted, it is much more likely that some of the water so formed will refreeze on the cold pavement before it can be removed therefrom. It can also be recognized that uncoated pavements are very porous and therefore will be wetted by water to a much greater extent than epoxy sealed pavement. As noted above under "Background Art", micro-waves can be used to fracture concrete pavements. The coating described above and used on concrete pavements 1 in the practice of my invention effectively protects the pavements so coated from fracturing by the application of micro-waves, especially at the high speed with which the micro-wave generator 8 may be passed over the coated pavement 1. This high speed of ice removal is particularly needed where airport runways are in need of ice removal. Since the concrete pavement is sealed from water by the coating, it will experience a greatly extended pavement life.

Figure 2:
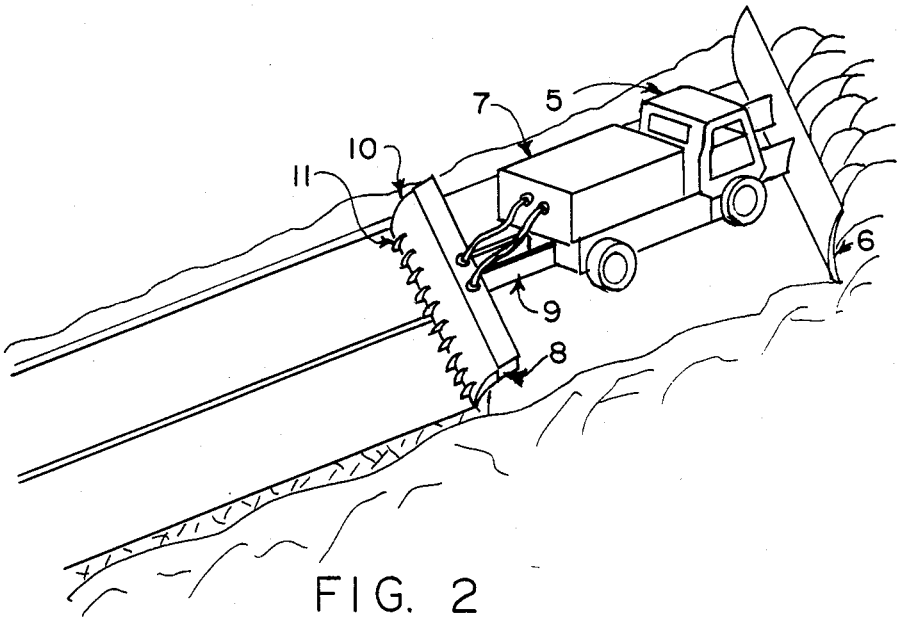
FIG. 2 is a perspective of a device for removing ice and snow from the carbonaceous surface of a pavement according to my invention.

As seen in FIG. 2, a preferred embodiment of a machine utilizing the principles of my invention consists of a truck 5 having a snowplow 6 carried by the front of the truck 5, an electric power plant 7 mounted on the truck bed connected to a micro-wave generator and wave guide 8 mounted on the rear of the truck by adjustable arms 9 with a scraper blade 10. A suitable micro-wave generator for this purpose is an RCA 8684 magnetron which is capable of generating useful continuous RF power of 30 kilowatts at 915 M-Hz. Mechanical ice-splitting blades 11 along the face of the scraper blade 10, as seen in FIG. 1, assist in breaking up the ice 13 as it is freed from the coated pavement 1. Because of the mass of the ice layer 13, it is essential that the scraper blade 10 be placed closely behind the micro-wave generator and wave guide 8 so that as soon as the ice 13 is freed, it will be fractured and pushed into a windrow along the downstream end of the scraper 10. Thus, the way of removing ice from pavements according to this invention can be performed by passing the truck 5, with associated equipment over the ice-coated pavement 1 at a speed such that as the interface 12 of ice 13 and pavement surface 4 is melted by the micro-wave generator and wave guide 8, the scraper blade 10 following the micro-wave generator and wave guide 8 will remove the ice coating 13 from the pavement 1.

I claim:

1. The method for removing ice from a pre-prepared pavement having an ice cover thereon, comprising the steps of:

(a) preparing the pavement by application to said pavement of a thin multi-layer top coat wear-resistant material comprising a microwave absorptive carbonaceous material layer and an aluminum containing underlayer material;

(b) passing a microwave generator and a cooperating waveguide over said pre-prepared pavement having ice cover thereon, said generator generating microwaves at a frequency permitting the microwaves to pass through said ice cover and to be absorbed by said microwave absorptive material at the interface between said thin multi-layer top coat wear-resistant material and said ice and said waveguide passing with sufficient speed to cause said interface to be heated without substantially warming the underlying pavement to thereby cause said ice to be rapidly released from said thin multi-layer top coat wear resistant material at said interface only; and, (c) scraping said ice from said thin multi-layer top coat wear-resistant material prior to said ice refreezing to said thin multi-layer top coat wear-resistant material.

2. The method as defined in claim 1, including the step of:

(a) cleaning said pavement prior to application of said top wear-resistant material.

3. The method as defined in claim 1, including the step of:

(a) generating microwaves at a frequency of substantially 915 MHz.

4. The method as defined in claim 3, including the step of:

(a) generating the microwaves with a power of 30 kilowatts.

5. The method as defined in claim 1, including the steps of:

(a) providing a ground supported mobile vehicle; and, (b) connecting said waveguide to said vehicles so that movement of said vehicle causes corresponding movement of said waveguide.

6. The method as defined in claim 1, including the step of:

(a) breaking-up the released ice.

7. The method as defined in claim 4, including the steps of:

(a) providing said vehicle with a scraper blade and ice splitting blades behind said scraper blade and with said scraper blade being behind said waveguide; and, (b) moving said vehicle and generating the microwaves so that said scraper blade scrapes the released ice from said wear-resistant material and said ice splitting blades fracture the scraped ice.

8. The method as defined in claim 1, including the step of:

(a) applying a wear-resistant material comprising a mixture of about 95% epoxy and about 5% graphite.

9. The method as defined in claim 1 wherein said preparing includes the steps of:

(a) applying to the pavement said underlayer wherein said underlayer includes epoxy;

(b) applying to said underlayer a second layer comprised of a rigid foamed phenolic sheet; and, (c) applying to said second layer a third layer comprising a graphite and epoxy mixture.

10. The method as defined in claim 1, including the steps of:

(a) applying an asphalt layer to said pavement.

11. The method of removing ice from a pre-prepared pavement having an ice cover thereon, comprising:

(a) preparing the pavement for ice removal by application thereto of a thin multi-layer top coat wear-resistant material having a microwave absorptive carbonaceous material layer and an aluminum containing underlayer material;

(b) passing a microwave generator having a cooperating waveguide over said pre-prepared pavement having an ice cover thereon, said generator generator microwaves of substantially 915 MHz so that the microwaves pass through said ice cover and are absorbed by said thin multi-layer to coat wear-resistant material at the interface between said thin multi-layer top coat wear-resistant material and said ice cover and said waveguide passing with sufficient speed to cause said interface to be heated without substantially warming the underlying pavement to thereby cause said ice cover to be rapidly released from said thin multi-layer top coat wear-resistant material at said interface only; and, (c) scraping said ice from overlying relation with said thin multi-layer top coat wear-resistant material prior to said ice refreezing to said thin multi-layer top coat wear-resistant material.

12. The method as defined in claim 11, including the step of:

(a) generating the microwaves with a continuous rf power of 30 kilowatts.

13. The method as defined in claim 11, including the step of:

(a) fracturing the ice after scraping the released ice from said thin multi-layer top coat wear-resistant material.

14. The method as defined in claim 11 wherein the step of preparing includes:

(a) applying to the pavement said underlayer which includes epoxy;

(b) applying to said underlayer a second layer comprising a rigid foamed phenolic sheet; and, (c) applying a graphite and epoxy mixture to said second layer.

15. The method as defined in claim 11, including the steps of:

(a) providing a pavement supported mobile vehicle; and, (b) connecting said waveguide to said vehicle so that movement of said vehicle causes corresponding movement of said waveguide.

16. The method as defined in claim 1, including the step of:

(a) applying an asphalt layer to said pavement.

17. A method of removing ice from a pre-prepared pavement having ice cover thereon, comprising the steps of:

(a) preparing the pavement for ice removal by application thereto of a thin multi-layer top coat wear-resistant material having a microwave absorptive carbonaceous material layer and an aluminum containing underlayer material;

(b) providing a pavement supported mobile vehicle;

(c) mounting a microwave generator having a cooperating waveguide to said vehicle;

(d) moving said vehicle and thereby said waveguide over said pre-prepared pavement having ice cover thereon, said generator generating microwaves at a frequency permitting microwaves to pass through said ice and to be absorbed by said thin multi-layer top coat wear-resistant material at the interface between said thin multi-layer top coat wear-resistant material and said ice cover and said vehicle moving at a speed sufficient to cause said interface to be heated without substantially warming the underlaying pavement to thereby cause said ice to be released from said thin multi-layer top coat wear-resistant material at said interface only; and, (e) removing said ice from overlying relation with said thin multi-layer top coat wear-resistant material prior to refreezing of said ice to said thin multi-layer top coat wear-resistant material.

18. The method as defined in claim 17, including the step of:

(a) providing an ice scraper mounted to said vehicle behind said waveguide so that said ice scraper scrapes said ice from said thin multi-layer top coat wear-resistant material subsequent to release therefrom.

19. The method as defined in claim 17, including the step of:

(a) generating the microwaves at substantially 915 MHz.

20. The method as defined in claim 19, including the step of:

(a) generating the microwaves at a continuous rf power of 30 kilowatts.

21. The method as defined in claim 17, including the step of:

(a) fracturing the ice after removal thereof from said thin multi-layer top coat wear-resistant material.

22. The method as defined in claim 17, including the step of:

(a) mounting a snow plow to a forward end of said vehicle and removing snow from said ice prior to said waveguide passing over said ice.

* * * * *